United States Patent [19]

Terhume

[11] Patent Number: 4,917,297

[45] Date of Patent: Apr. 17, 1990

[54] SNOW GUN

[76] Inventor: Mike Terhume, 4572 Excalibur Ct., Colorado Springs, Colo. 80917

[21] Appl. No.: 335,859

[22] Filed: Apr. 10, 1989

[51] Int. Cl.[4] ..... F25C 3/04

[52] U.S. Cl. ..... 239/14.2

[58] Field of Search ..... 239/2.2, 14.2, 423, 239/424, 424.5, 430, 433, 114, 123

[56] References Cited

U.S. PATENT DOCUMENTS

| | | | |
|---|---|---|---|
| 2,398,884 | 4/1946 | Crowe | 239/423 |
| 3,335,956 | 8/1967 | Janes | 239/424 |
| 4,145,000 | 3/1979 | Smith et al. | 329/14.2 |
| 4,504,013 | 3/1985 | Huffman | 239/424 |
| 4,813,597 | 3/1989 | Rumney et al. | 239/14.2 |

*Primary Examiner*—Andres Kashnikow
*Assistant Examiner*—Karen B. Merritt
*Attorney, Agent, or Firm*—Michael J. Delaney

[57] ABSTRACT

A snow gun for making snow by atomizing water and projecting the atomized water by compressed air into an atmosphere having an ambient temperature below about 32 degrees F. has a one piece body member with a first water opening through one side and ending within the body member. A pair of second water openings extend through the opposite side of the body member and are in communication with the first water opening. Water outlet ports extend from the pair of second water openings and at an angle and through the front of the body member. An air opening extends through one side of the body member and terminates within the body member. Air outlet ports extend from the air opening through the front of the body member adjacent and between the water outlet ports. A pattern plate is attached to the front of the body member and has a slot in communication with the air and water outlet ports. Clean out plugs close the pair of second water openings at the side of the body member. Water is introduced to the body member at the first water opening and leaves the body member at the water outlet ports. Compressed air is introduced to the body member and leaves the body member at the air outlet ports. The compressed air atomizes the water and projects it through the pattern plate into the atmosphere to form snow.

7 Claims, 2 Drawing Sheets

FIG. 1
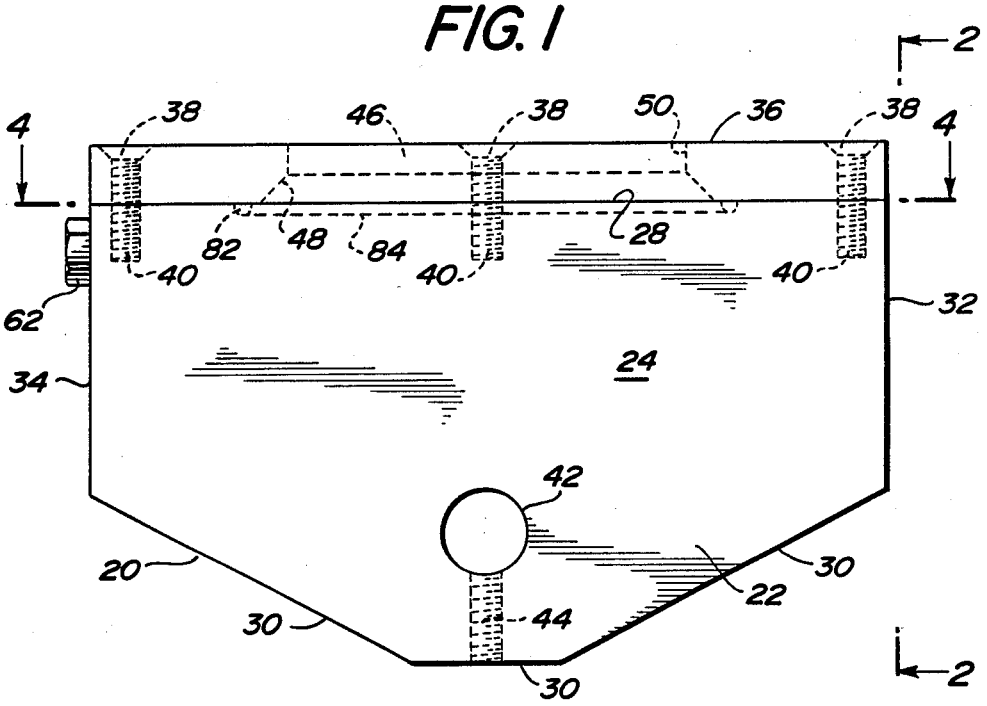
FIG. 2
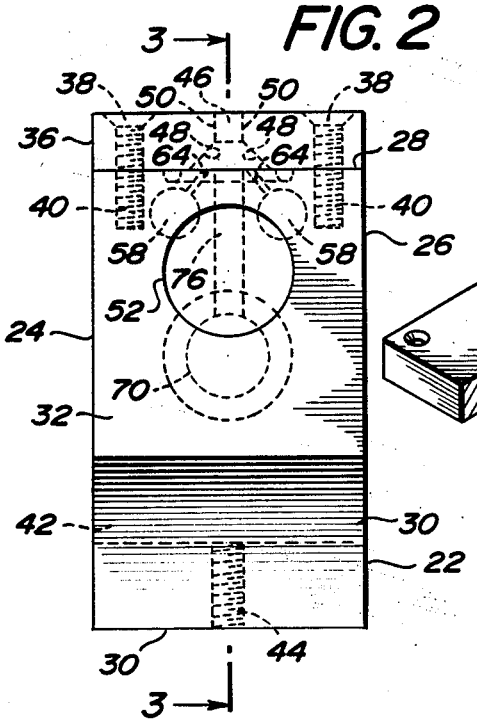
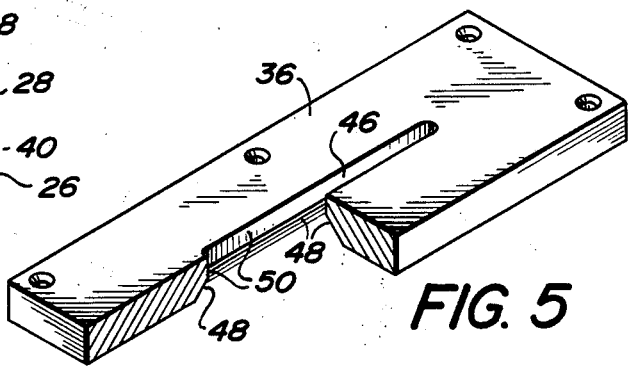
FIG. 5
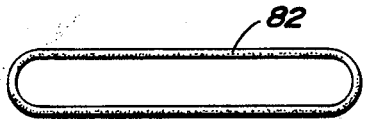
FIG. 6

FIG. 3
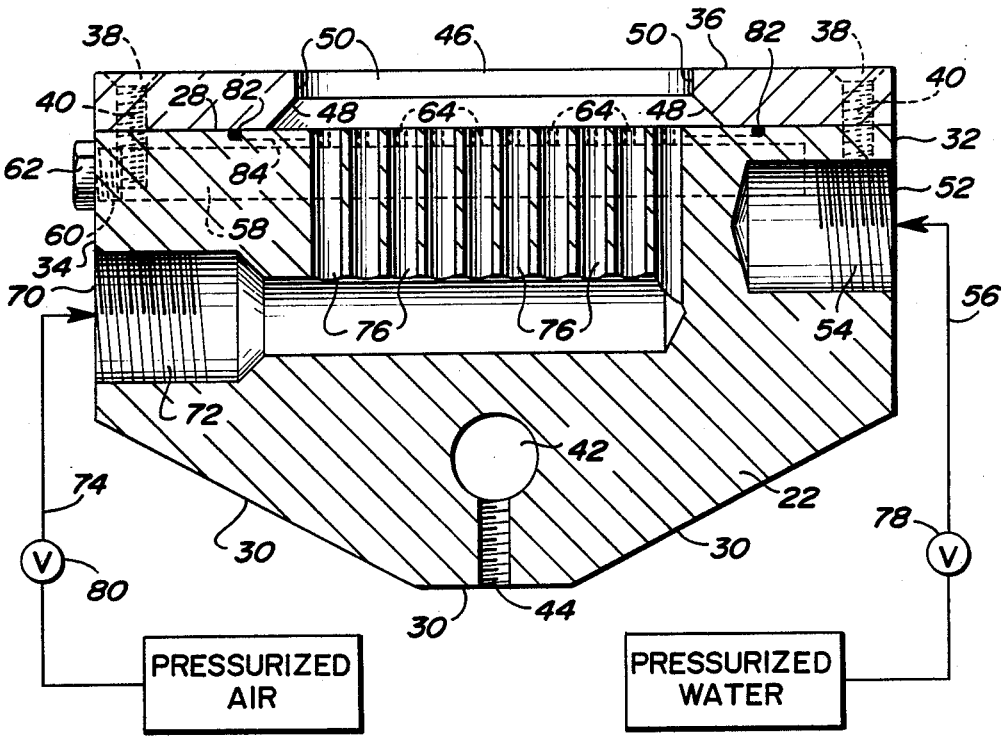
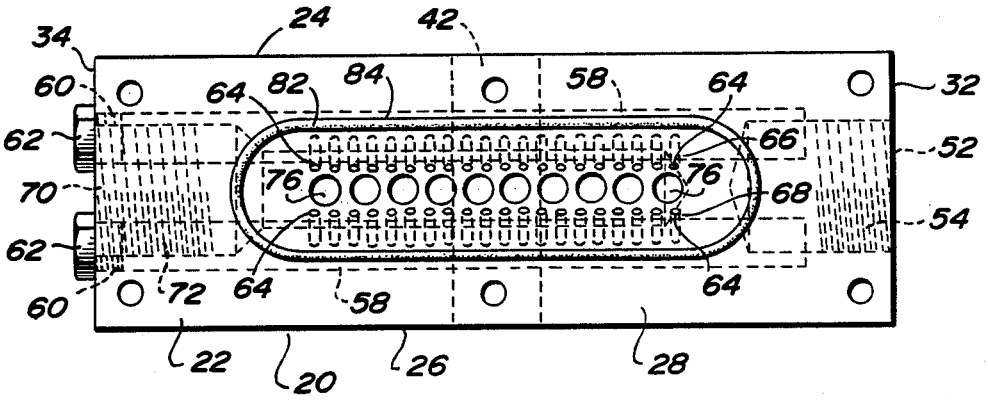
FIG. 4

SNOW GUN

BACKGROUND OF THE INVENTION

This invention is directed generally to a snow gun assembly for making snow and in particular to a gun assembly having a unitary body member wherein water under pressure and compressed air are admitted to the body member. The water stream and air stream pass through the body member and are discharged under pressure at water outlets and air outlets where the streams meet and the water is atomized and projected through a pattern plate to the atmosphere to form snow.

The making of artificial snow at this point in time is more an art than a science. However, as pointed out in the publication *SKI AREA MANAGEMENT* for Sept. 1983 in an article beginning on page 67 titled "A Primer On Air-to-Water Ratios" by Norman G. Smith, certain factors are known, e.g., (1) only water makes snow, (2) the capital and operating costs of supplying air to a snow making system are many times that of supplying water, (3) all snow guns are not created equal, (4) all things being equal the efficiency of a snow gun is determined by its air to water ratio with the lower the ratio the higher the efficiency.

The prior art snow guns have certain problems which the snow gun of this invention overcomes. The prior art guns had one or more of the following problems: (1) a high air to water ratio, (2) a non-uniform, too large and/or too small water droplets, (3) too bulky and/or too heavy in weight, (4) difficult to clean, (5) a snow making pattern which was too wide or too narrow, (6) too high an operational noise level, (7) difficult to mount during use, (8) difficult and/or expensive to manufacture, (9) tendency to freeze up during use, and (10) not durable and expensive to maintain.

SUMMARY OF THE INVENTION

It is an object of this invention to provide a snow gun which overcomes all of the above problems.

The snow gun of the invention is designed to provide a low air to water ratio and thus a high efficiency snow gun, which produces a spray pattern of water droplets of uniform size. The droplets are not too large as to produce a wet snow or too small to produce too dry a snow which floats away and does not provide significant snow accumulation.

The snow gun of this invention is compact and light in weight compared to prior art guns. Thus the gun of this invention can be easily transported and set up without excess physical effort on the part of the person making snow.

In use, the water supplied to snow guns may contain a variety of impurities, such as, dirt, small rocks, pond sediment, leaves, fish scales, etc. These impurities tend to block the water passageways of a snow gun. The snow gun of this invention is easily cleaned by the removal of clean out plugs in the water distribution system. Normally these clean out plugs allow the gun to be cleaned on the snow making site without taking the gun off line. However, if the blockage is such that a gun must be taken off line, these plugs greatly facilitate cleaning of the gun. These plugs also provide for the installation of a water pressure gauge to the gun to monitor its performance.

The snow gun of this invention produces a snow pattern which is neither too wide nor too narrow. If the pattern is too wide, the gun tends to produce snow that is too dry on the periphery of the pattern and too wet on the center of the pattern. If the pattern is too narrow it will not provide the proper coverage of the snow slope without moving the guns many times.

Frequently snow slopes are located relatively close to residential areas and since snow is frequently made during the evening hours a snow gun should operate at a low noise level to minimize disturbing the residents. The snow gun of this invention operates at a low noise level.

Since many snow guns are used during a snow making operation it is very desirable to provide a snow gun which has features which allow the gun to be easily mounted and removed from a mounting stand. The snow gun of this invention includes such features.

The snow gun of this invention, while a precision gun, is very easy and economical to manufacture and as a result the snow guns produced according to this invention are uniform and dependable.

The snow gun of this invention does not have a tendency to freeze up during use because the location and arrangement of the water passageways including the water openings and ports tend to maintain the body of the gun adjacent the water passageways at a temperature which mitigates against freeze ups.

The snow gun of this invention is very durable and inexpensive to clean and maintain due to the design of the water and air passageways and the design of the pattern plate.

BRIEF DESCRIPTION OF THE DRAWINGS

FIG. 1 is a plan view of the snow gun of this invention with most dotted lines not shown for the sake of clarity.

FIG. 2 is a view taken along the lines 2—2 of FIG. 1.

FIG. 3 is a view taken along the lines 3—3 of FIG. 2 with pressurized air and water lines added.

FIG. 4 is a view taken along the lines 4—4 of FIG. 1.

FIG. 5 is a perspective view of the pattern plate of the snow gun of this invention.

FIG. 6 is a view of an o ring.

DETAILED DESCRIPTION OF THE DRAWINGS

Referring to FIGS. 1 and 2, a snow gun generally indicated by numeral 20 includes a unitary body member 22 having a top surface 24, a bottom surface 26 opposite the top surface 24, a front surface 28, a rear surface 30 opposite the front surface 28, a first side surface 32, and a second side surface 34 opposite the first side surface 32. A pattern plate 36 extends over and is removably secured to the front surface 28 by means of bolts 38 extending through holes in the pattern plate 36 and in threaded engagement with threaded holes 40 in the front surface 28 of the body member 22. Positioned between the pattern plate 36 and the front surface 28 of body member 22 is an oval shaped O ring 82, best shown in FIG. 6. O ring 82 is placed in oval shaped groove 84 in the front surface 28 of body member 22, best shown in FIG. 4. O ring 82 acts as seal between pattern plate 36 and body member 22. Adjacent the rear surface 30 of the body member 22 is a mounting hole 42 which extends through the body member 22 from top surface 24 through bottom surface 26. A threaded hole 44 extends through rear surface 30 of body member 22 perpendicular to the longitudinal axis of mounting hole 42 and intersecting mounting hole 42. A rod (not shown) can be secured to the ground or a stand and passed through mounting hole 42. A bolt (not shown) can be placed in threaded engagement with the threaded hole 44 and in contact with the rod (not shown) to secure the body member 22 in a stationery position during use of the gun 20.

As shown in FIGS. 1, 2, 3 and 5, pattern plate 36 has an elongated slot 46 having outwardly tapered sides 48 and straight sides 50 to form a converging nozzle. As best shown in FIG. 3, the length of slot 46 is greater than the length of the row of outlet ports 76 and the row of water outlet ports 64.

Referring to FIGS. 2, 3 and 4, body member 22 has a first water opening 52 through the first side surface 32 and terminating within body member 22. A portion of the first water opening 52 adjacent the first side surface 32 includes an internally threaded portion 54 to receive a threaded water line 56 which includes a valve 78 and supplied pressurized water to the snow gun 20, as shown in FIG. 3. Body member 22 has a pair of second water openings 58 in the second side surface 34. The pair of second water openings 58 extend substantially parallel to each other and towards said first side surface 32. The pair of second water openings 58 terminate within the first water opening 52. A portion of each second water opening 58 adjacent the second side surface 34 includes an internally threaded portion 60 to receive a threaded plug 62, as shown in FIGS. 3 and 4.

As best seen in FIGS. 2 and 4, a plurality of spaced water outlet ports 64 extend at about a 45 degree angle to the front surface 28 from each second water opening 58 and pass through front surface 28 of body member 22. As best seen in FIG. 4, the water outlet ports 64 form a top row 66 and a bottom row 68 of water outlet ports 64. Each row 66, 68 of water outlet ports 64 are in communication with the elongated slot 46 of pattern plate 36.

As best seen in FIGS. 3 and 4, an air opening 70 extends through second side surface 34 towards first side surface 32 and terminates within body member 22. A portion of air opening 70 adjacent the second side surface 34 includes an internally threaded portion 72 to receive a pressurized air supply line 74 including a valve 80, as shown in FIG. 3. A plurality of spaced air outlet ports 76 extend from the air opening 70 substantially parallel to each other and through the front surface 28 of the body member 22 immediately adjacent to and between the rows 66, 68 of spaced water outlet ports 64.

FIG. 6 shows an oval shaped O ring 82 which as described above is placed in groove 84 in the front surface 28 of body member 22, as best seen in FIG. 4. The o ring surrounds the water outlet ports 64 and the air outlet ports 76.

In use the snow gun 20 is mounted on a stand (not shown) by means of a rod (not shown) passing through mounting hole 42 and secured thereto by means of a threaded bolt (not shown) in threaded engagement with threaded hole 44. Pressurized air supply line 74 is connected to air opening 70 by means of threaded portion 72, and pressurized water supply line 56 is connected to first water opening 52 by means of threaded portion 54. The valves 78 and 80 are opened and adjusted to allow pressurized water and air to be supplied to the gun 20. The pressurized air passes through air opening 70 of the gun 20 and air outlet ports 76. The pressurized water passes through first water opening 52, the pair of second water openings 58, and water outlet ports 64. As the pressurized air leaves the body member 22 at air outlet ports 76, the pressurized air meets the pressurized water leaving the body member 22 at water outlet ports 64, the pressurized air atomizes the water and projects the atomized water through the converging nozzle of the pattern plate 36 formed by tapered sides 48 and straight sides 50 of slot 46 into the atmosphere to form snow. Since the pressurized water follows a circuitous path through the first water opening 52 which is a blind opening, then changes direction and passes into the pair of second water openings 58, and finally changes direction another time and passes through water outlet ports 64, the pressurized water is in such a condition as to be susceptible to being readily atomized.

If the water passages of the gun 20 should become blocked, a length of wire or similar tool can be inserted through second water openings 58 after removal of plugs 62 and passed through the second water openings 58 and exit the body member 22 through first water opening 52. In addition, the wire can be passed through the water outlet ports 64 to clean the ports 64. Generally, the gun 20 can be cleaned readily while the gun 20 is still on the snow making site.

Tests were conducted to determine the performance of the snow gun 20 of this invention with respect to several other prior art snow guns available in the market place. The following is a chart showing results of such tests.

| | | | TEMPERATURES IN DEGREES F. | | |
|---|---|---|---|---|---|
| SNOW GUN | | SNOW MAKING 30–32 | 25 | 20 | 10 |
| Gun A | Air Flow | 470 CFM | 425 CFM | 375 CFM | 200 CFM |
| | Water Flow | 16 GPM | 33 GPM | 45 GPM | 55 GPM |
| | Air/Water Ratio | 29:1 | 13:1 | 8:1 | 3.6:1 |
| Gun B | Air Flow | 450 CFM | 400 CFM | 330 CFM | 150 CFM |
| | Water Flow | 16 GPM | 30 GPM | 40 GPM | 50 GPM |
| | Air/Water Ratio | 28:1 | 13:1 | 8:1 | 3:1 |
| Gun C | Air Flow | 1000 CFM | 800 CFM | 570 CFM | 400 CFM |
| | Water Flow | 22 GPM | 40 GPM | 50 GPM | 60 GPM |
| | Air/Water Flow | 45:1 | 20:1 | 11:1 | 7:1 |
| Gun D | Air Flow | 900 CFM | 775 CFM | 550 CFM | 500 CFM |
| | Water Flow | 24 GPM | 40 GPM | 50 GPM | 60 GPM |
| | Air/Water Flow | 38:1 | 19:1 | 11:1 | 8:1 |
| Gun E | Air Flow | 1000 CFM | 850 CFM | 650 CFM | 600 CFM |
| | Water Flow | 28 GPM | 45 GPM | 60 GPM | 70 GPM |
| | Air/Water Flow | 36:1 | 19:1 | 11:1 | 11:1 |

In the above chart, Gun A is the snow gun described in this specification; Guns B, C, D and E are prior art guns; GPM=gallons per minutes, and CFM=cubic feet per minute.

As can be seen in the above chart the air/water ratio of Gun A, which is the gun described in this specification, is substantially lower than the air/water ratio of prior art Guns C, D, and E and about equal to the air/water ratio of Gun B.

The following are the weights of the guns of the above tests:

Weight of Gun A (this invention)=7 pounds.
Weight of Gun B=9 pounds.
Weight of Gun C=14 pounds.
Weight of Gun D=32 pounds.
Weight of Gun E=20 pounds.

Thus, while the air/water ratio of the Gun A of this invention is about equal to the air/water ratio of prior art Gun B, Gun A of this invention is superior to Gun B because of the inherent resistance to freeze up displayed by the gun of this invention during use, due to the position of the water outlet ports 64 and water passageways which act as a radiator to maintain the adjacent gun body at a temperature which reduces the tendency for freeze ups. In addition, the gun of this invention is more durable, less expensive to manufacture and maintain than the Guns B–E.

It has been found that a snow gun made from aircraft grade, anodized aluminum in accordance with this invention having the following dimensions performed as set forth in the above chart.

Overall width of the gun 20=7 inches.
Overall height of the gun 20=2.5 inches.
Overall depth of the gun 20=4¼ inches.
Thickness of pattern plate 36=½ inch.
Length of slot 46 of pattern plate 36=3 inches.
Depth of straight sides 50 of pattern plate 36=¼ inch.
Width of slot in outer surface of pattern plate=¼ inch.
Angle of taper of tapered sides 48 of pattern plate=45 degrees.
Diameter of water outlet ports 64=0.095 inches.
Number of water outlet ports 64 per row=23.
Angle between front surface 28 and water outlet ports 64=45 degrees.
Length of a row of water outlet ports 64=2 5/16 inches.
Diameter of air outlet ports 76=0.250 inches.
Number of air outlet ports 76=8.
Length of row of air outlet ports 76=2⅜ inches.
Diameter of O ring 82=⅛ inches.
Depth of groove 84=1/16 inch.
Width of groove 84=1¼ inches.
Length of groove 84=4½ inches.

While I have described my invention in considerable detail, I do not want to be limited to the exact details disclosed but I may wish to make such changes in shape, size location and material of the various components and still be within the spirit of my invention.

I claim:

1. A gun assembly for making snow by atomizing water and projecting the atomized water by compressed air into an atmosphere having an ambient temperature below about 32 degrees F. to form snow, said gun assembly comprising: p1 (a) a unitary body member having a top surface, a bottom surface opposite said top surface, a first side surface, a second side surface opposite said first side surface, a front surface and a rear surface, (b) a first water opening in said first side surface extending towards said second side surface and terminating within said body member, (c) a pair of second water openings in said second side surface extending substantially parallel to each other towards said first side surface and terminating within said first water opening, (d) a plurality of spaced water outlet ports extending from each of said pair of second water openings through and at an angle to said front surface with the spaced water outlet ports of one of said pair of second water openings extending toward the spaced water outlet ports of the other of said pair of second water openings, (e) an air opening in one of said first and second side surfaces extending towards the other of said first and second side surfaces and terminating within said body member, (f) a plurality of spaced air outlet ports extending from said air opening substantially perpendicular to and through said front surface immediately adjacent to and between said plurality of spaced water outlet ports, (g) a pattern plate removably secured to said front surface and having a slot extending therethrough and in communication with said air outlet ports and said water outlet ports, and (h) removable means to close said pair of second water openings at said second side surface.

2. The gun assembly of claim 1 further including an oval shaped O ring positioned between said pattern plate and said front surface and surrounding said water outlet ports and said air outlet ports.

3. The gun assembly of claim 1 further comprising means for supplying water under pressure to said first water opening for passage through said first water opening, said pair of second water openings and said plurality of spaced water outlet ports, and means for supplying compressed air to said air opening for passage through said air opening and said plurality of spaced air outlet ports such that said air contacts said water, atomizes it and projects said atomized water into the atmosphere to form snow.

4. The gun assembly of claim 1 wherein said slot of said pattern plate is in the shape of a converging nozzle.

5. The gun assembly of claim 1 wherein the said plurality of spaced water outlet ports extend at a 45 degree angle to said front surface.

6. The gun assembly of claim 1 wherein said unitary body member has a hole extending through it from said top surface to said bottom surface to facilitate mounting said gun assembly when in use to make snow.

7. The gun assembly of claim 2 further comprising means for supplying water under pressure to said first water opening for passage through said first water opening, said pair of second water openings and said plurality of spaced water outlet ports, and means for supplying compressed air to said air opening for passage through said air opening and said plurality of spaced air outlet ports such that said air contacts said water, atomizes it and projects said atomized water into the atmosphere to form snow, said slot of said pattern plate is in the shape of a converging nozzle, said plurality of spaced water outlet ports extend at a 45 degree angle to said front surface, and said unitary body member has a hole extending through it from said top surface through said bottom surface to facilitate mounting said gun assembly when in use to make snow.

* * * * *